United States Patent [19]

Stein

[11] Patent Number: 4,732,060

[45] Date of Patent: Mar. 22, 1988

[54] CLAMP FOR BICYCLE CRANK BEARING WRENCH

[76] Inventor: James A. Stein, 711½ Miller Valley Rd., Prescott, Ariz. 86301

[21] Appl. No.: 825,468

[22] Filed: Feb. 3, 1986

[51] Int. Cl.[4] ..... B25B 29/00

[52] U.S. Cl. ..... 81/57.4; 81/462; 269/52

[58] Field of Search ..... 269/91, 93, 47, 52; 403/259, 260, 261; 411/412, 413, 432, 378; 279/7; 81/57.24, 57.35, 57.4, 180.1, 184, 125, DIG. 1, 488, 462, 451–459; 29/238, 281.1, 283, 426.5

[56] References Cited

U.S. PATENT DOCUMENTS

| | | | |
|---|---|---|---|
| 2,632,350 | 3/1953 | Kaster | 81/462 |
| 3,402,613 | 9/1968 | Neusel | 411/413 |
| 4,005,622 | 2/1977 | Bassett | 81/180.1 |
| 4,372,015 | 2/1983 | Rhoton | 269/47 |
| 4,439,096 | 3/1984 | Rockwood | 411/378 |

FOREIGN PATENT DOCUMENTS

| | | | |
|---|---|---|---|
| 1106706 | 5/1961 | Fed. Rep. of Germany | 81/462 |

*Primary Examiner*—Frederick R. Schmidt
*Assistant Examiner*—Bradley I. Vaught

[57] ABSTRACT

A clamp to secure the location of a spanner wrench on the bearing cup of a bicycle crank bearing during the installation or removal of the bearing cup from the bicycle frame crank housing.

1 Claim, 7 Drawing Figures

CLAMP FOR BICYCLE CRANK BEARING WRENCH

BACKGROUND OF THE INVENTION

The invention relates to the installation or removal of the bearing race of a bicycle crank. The invention is applicable to bicycles in which the bearing races are installed into an internally threaded housing of the frame. The invention relates to the period of installation or removal of the bearing race when sufficient torque must be applied to lock the bearing race into place or to break it loose.

Conventional methods of installation or removal require more time or produce inadequate torque capacity. A means of overcoming these problems is provided by this invention.

SUMMARY OF THE INVENTION

This invention provides the user with a fast, efficient means of installing or removing the fixed bearing race (fixed-cup) of a bicycle crank set. The torque capacity of a standard spanner wrench is limited only by the user's ability to maintain its location on the wrench flats of the fixed-cup. The object of this invention is a means of providing positive location of the wrench on the flats of the fixed-cup.

A requirement for this invention is to be compatible with the majority of existing crank bearings and tools.

BRIEF DESCRIPTION OF THE DRAWING

This invention may be more readily described by reference to the accompanying drawings.

DESCRIPTION OF THE PREFERRED EMBODIMENTS

Figure 1:
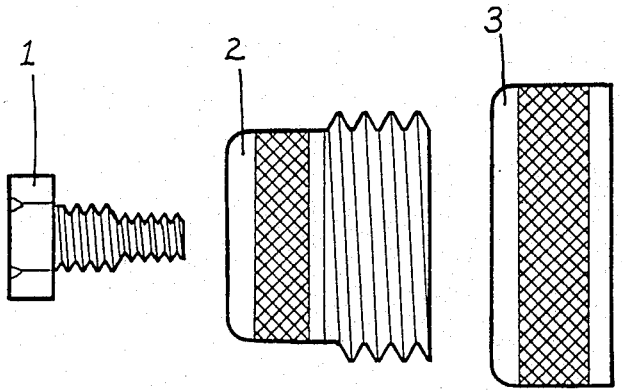
FIG. 1 is a side view showing the three components separated.
Figure 2:
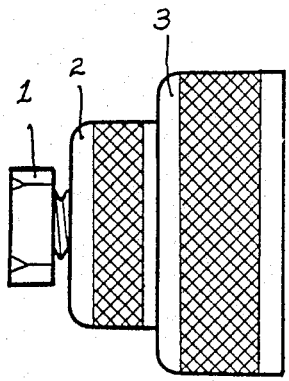
FIG. 2 is a side view showing the three components assembled.
Figure 3:
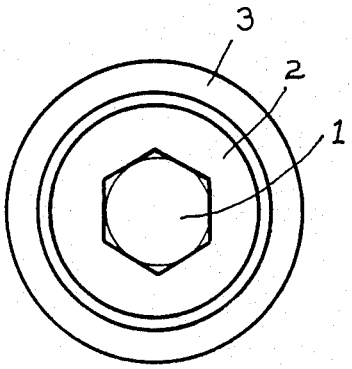
FIG. 3 is an axial view from the "outside" of FIG. 2.
Figure 4:
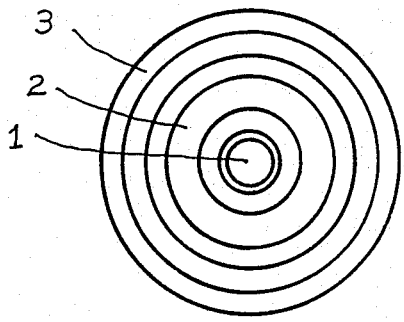
FIG. 4 is an axial view from the "inside" of FIG. 2.

Referring more particularly to the drawings by characters of reference, FIG. 1 discloses the three components of the invention. The body 2 is composed of an internally and externally threaded member. The adjusted ring 3 is internally threaded the same as the external threads of the body 2. Both pieces are knurled to provide the user a good grip. The adapter bolt is externally threaded with two sizes of threads as required.

Figure 5:
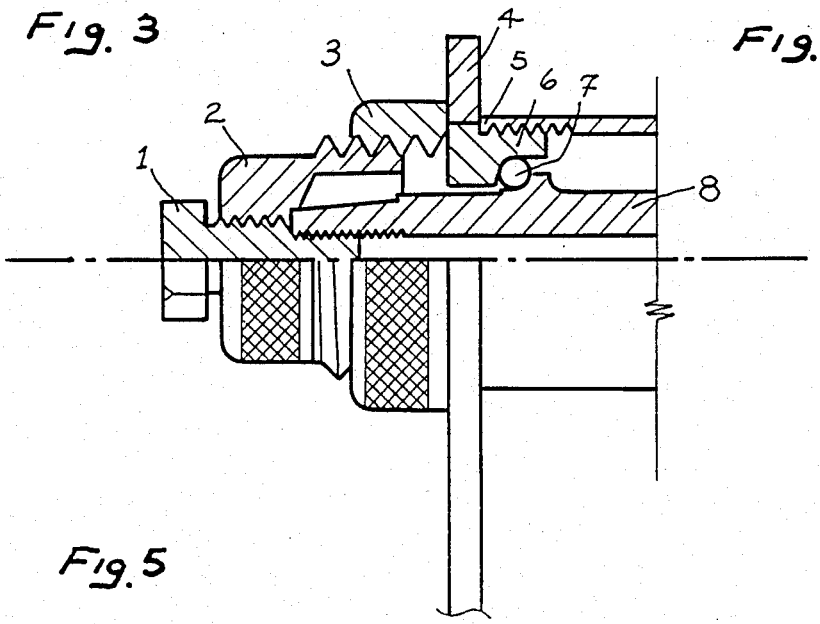
FIG. 5 is a half section of the invention in place.
Figure 6B:
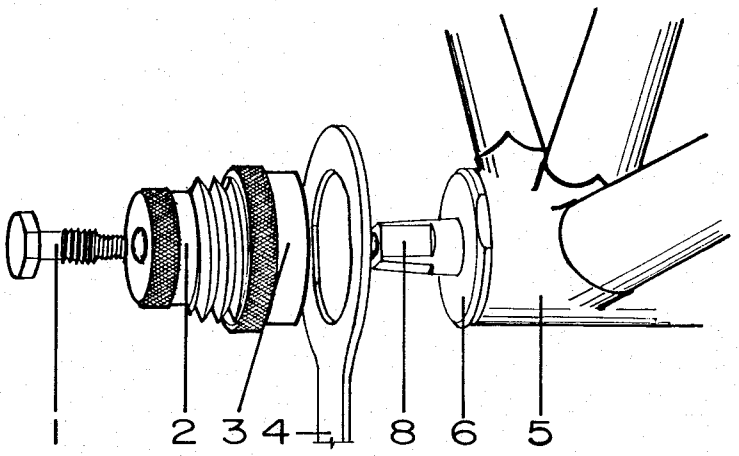
FIG. 6B is a view of the invention assembly.
Figure 6A:
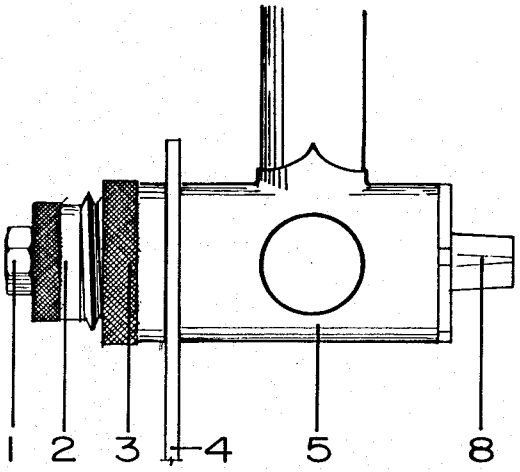
FIG. 6A is a view of the invention in use.

Referring to FIG. 5, a standard fixed cup installation (removal) wrench 4 is shown attached to the fixed-cup 6. It is clamped in place between the internally threaded bicycle frame crank housing 5 and the adjusting ring 3 of the invention. The adjusting ring 3 of the invention is threaded on the body 2, which is then held in place on the spindle 8 by the adapting bolt 1, or simply threads onto spindles provided with an externally threaded stud. The spindle 8 carries the tension back to the bearing 7, which are in turn transferred to the fixed cup and thusly into the crank housing of the bicycle frame.

The outer ring 3 of the invention is turned relative to the body 2, until it contacts the wrench 4, thereby providing adjustment of the tool to various length spindles 8, and providing clamping pressure against the wrench 4 to provide a positive location on the fixed cup 6.

What is claimed is:

1. A clamp for a bicycle bearing wrench comprising; a body externally threaded to provide adjustment and clamping force and internally threaded to fasten to spindles provided with an externally threaded stud or to a bolt having two coaxial threads of different diameters;

an outer ring having threads to match the external of the body to provide adjustment to different length spindles and to provide a clamping force against the outer surface of a spanner wrench;

a bolt provided with coaxial threads of two different diameters; one of said bolt threads sized to fit the internal threads of the body and the other of said bolt threads sized to fit the internal threads of the spindle when the spindle is provided with such internal threads;

whereby the spanner wrench can be clamped to the spindle by the outer ring for assembly and disassembly of a bicycle crank assembly.

* * * * *